US006240755B1

(12) United States Patent
Da Silva

(10) Patent No.: US 6,240,755 B1
(45) Date of Patent: Jun. 5, 2001

(54) HANDLE FOR THE DOOR OF AN AUTOMOBILE VEHICLE COMPRISING A LOCK CYLINDER CAP

(75) Inventor: David Da Silva, Albert (FR)

(73) Assignee: Valeo Securite Habitacle, Creiteil (FR)

( * ) Notice: Subject to any disclaimer, the term of this patent is extended or adjusted under 35 U.S.C. 154(b) by 0 days.

(21) Appl. No.: 09/502,319

(22) Filed: Feb. 11, 2000

(30) Foreign Application Priority Data

Feb. 12, 1999 (FR) ..... 99 01685

(51) Int. Cl.[7] ..... E05B 17/18

(52) U.S. Cl. ..... 70/423; 70/455; 292/336.3

(58) Field of Search ..... 70/423–428, 455, 70/DIG. 43, DIG. 56, 208; 292/336.3, DIG. 31

(56) References Cited

U.S. PATENT DOCUMENTS

| | | | | |
|---|---|---|---|---|
| 1,590,981 | * | 6/1926 | Lockyer | 70/237 |
| 1,843,586 | * | 2/1932 | Werckmeister | 70/428 X |
| 2,070,955 | * | 2/1937 | Parisoe | 70/455 |
| 2,132,287 | * | 10/1938 | Curtis et al. | 70/455 |
| 2,140,239 | * | 12/1938 | Lewis | 16/86 |
| 2,217,730 | * | 10/1940 | Cooley | 70/455 |
| 2,247,592 | * | 7/1941 | Swift | 70/455 |
| 2,564,012 | * | 8/1951 | Jordan | 70/455 |
| 2,585,331 | * | 2/1952 | King | 70/455 |
| 2,658,376 | * | 11/1953 | Shank | 70/455 |
| 2,670,623 | * | 3/1954 | Haltenberger | 70/455 |
| 4,798,069 | * | 1/1989 | De Forrest, Sr. | 70/428 |

FOREIGN PATENT DOCUMENTS

| | | | | |
|---|---|---|---|---|
| 555519 | * | 7/1932 | (DE) | 70/424 |
| 802 047 | | 2/1951 | (DE) . | |
| 802047 | * | 2/1951 | (DE) | 70/455 |
| 21 00 071 | | 8/1972 | (DE) . | |
| 3716370 | * | 11/1988 | (DE) | 70/455 |
| 4109394 | * | 9/1992 | (DE) | 70/423 |
| 197 24 573 | | 12/1998 | (DE) . | |
| 1 141 288 | | 8/1957 | (FR) . | |
| 2 681 628 | | 3/1993 | (FR) . | |
| 2 753 475 | | 3/1998 | (FR) . | |
| WO88/07118 | * | 9/1988 | (WO) | 70/416 |

* cited by examiner

*Primary Examiner*—Lloyd A. Gall
(74) *Attorney, Agent, or Firm*—Morgan & Finnegan, L.L.P.

(57) ABSTRACT

The invention proposes a handle for the door of an automobile vehicle, of the type in which the handle comprises an external gripping lever that is designed to be moved by a user from a rest position to an open position to control a lock that is associated with a lock cylinder of the type comprising a stator, one end of which is accessible from the outside so that a key can be inserted in the lock cylinder through a slit that opens out into the end of the cylinder, wherein the gripping lever comprises a protective cap and/or trim covering the lock cylinder that is assembled so that it is free to slide with respect to the gripping lever between a normal assembly position in which the cap conceals at least the slit in the lock cylinder when the gripping lever is in its rest position, and a displaced position enabling access to the key insertion slit.

10 Claims, 2 Drawing Sheets

FIG.2
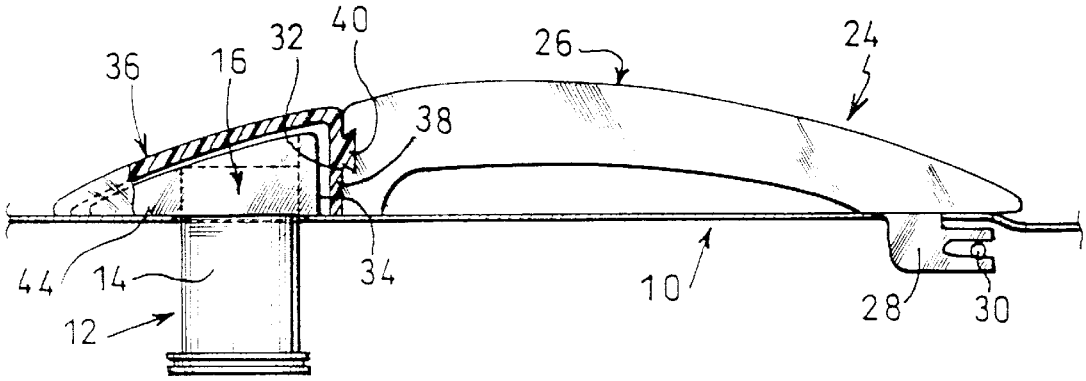
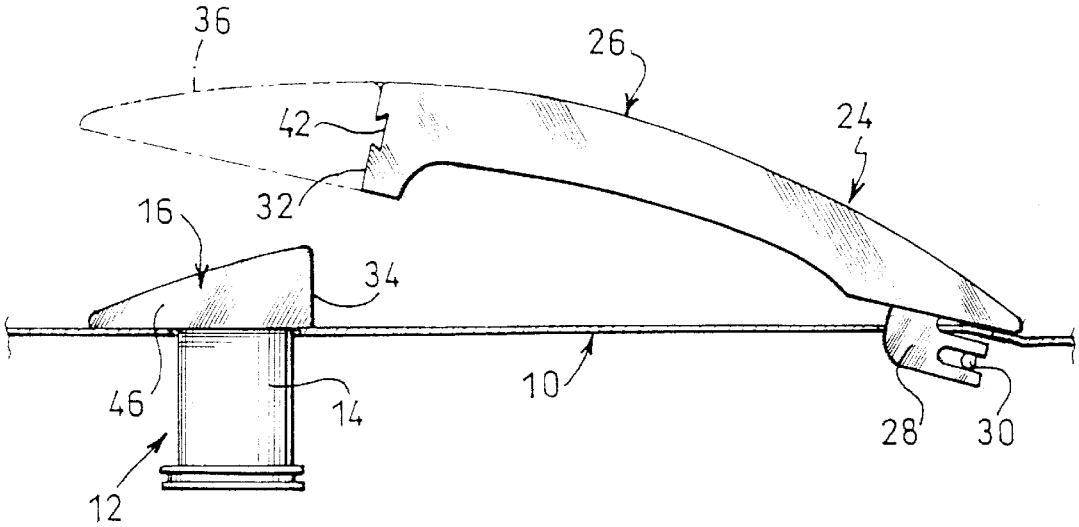
FIG.3

HANDLE FOR THE DOOR OF AN AUTOMOBILE VEHICLE COMPRISING A LOCK CYLINDER CAP

BACKGROUND OF THE INVENTION

This invention relates to a handle for the door of an automobile vehicle comprising improved means of protecting a lock cylinder associated with the lock that it controls.

The invention is more particularly applicable to a handle for the door of an automobile vehicle of the type in which the handle comprises an external gripping lever that is designed to be moved by a user from a rest position to an open position to control a lock that is associated with a lock cylinder of the type comprising a lock cylinder stator, one end of which is accessible from the outside so that a key can be inserted into the lock cylinder through a slit opening into the end.

The invention is particularly applicable in the case of a vehicle for which access is managed by "electronic" means, in other words in which drivers do not normally use conventional mechanical keys that they insert into lock cylinders, but use other identification devices called electronic keys that enable them to access the vehicle, and therefore to activate lock mechanisms using handles when they get close to the vehicle.

However, for some applications, or when there is a failure of the electronic identification devices, the driver may need to insert a conventional mechanical key into a lock cylinder before he can enter his vehicle.

During normal use, the mechanical lock cylinder is not used, and it is desirable to be able to protect it to avoid dirt or other foreign bodies that could enter into the slit into which the key is inserted. Furthermore, the end of the lock cylinder and the insertion slit are unaesthetic elements that detract from the general design of the handle.

BRIEF SUMMARY OF THE INVENTION

In order to overcome these disadvantages, the invention proposes an automobile vehicle door handle of the type in which the handle comprises an external gripping lever that is designed to be moved by a user from a rest position to an open position to control a lock that is associated with a lock cylinder of the type comprising a stator, one end of which is accessible from the outside so that a key can be inserted in the lock cylinder through a slit that opens out into the end of the lock cylinder, characterized in that the gripping lever comprises a protective cap and/or trim covering the lock cylinder that is assembled so that it is free to move with respect to the gripping lever between a normal assembly position in which the cap conceals at least the slit in the lock cylinder when the gripping lever is in its rest position, and a displaced position enabling access to the key insertion slit.

According to other characteristics of the invention:

- the cap is installed free to slide with respect to the body of the gripping lever;
- the cap is mounted free to slide with respect to the body of the gripping lever along a direction parallel to the hinge pin of the gripping lever with respect to the door;
- the cap is free to slide with respect to the body of the gripping lever by mortise and tenon type means;
- the cap can only be moved with respect to the body of the gripping lever when the gripping lever is in the open position;
- the cap is in the form of an envelope, the internal profile of which is approximately complementary to the external profile of the end that it surrounds when the gripping lever is in the rest position;
- the cap is a molded part made of a plastic material;
- the body of the gripping lever extends along a direction approximately perpendicular to its hinge pin with respect to the door;
- the hinge pin about which the gripping lever rotates with respect to the door is parallel to the general plane of the door;
- the hinge pin about which the gripping lever rotates with respect to the door is oriented vertically.

BRIEF DESCRIPTION OF THE DRAWINGS

Other characteristics and advantages of the invention will become evident when reading the following detailed description, which will be more easily understood by reference to the attached drawings in which:

FIG. 2 is a top view, illustrated as a partial longitudinal sec on, of the handle in FIG. 1 in which the gripping lever is in the rest position and the cap is in the raised position; and FIG. 3 is a view similar to FIG. 2 on which the gripping lever is illustrated in the open position with the cap shown as an outline.

DETAILED DESCRIPTION OF THE INVENTION

Figure 1:
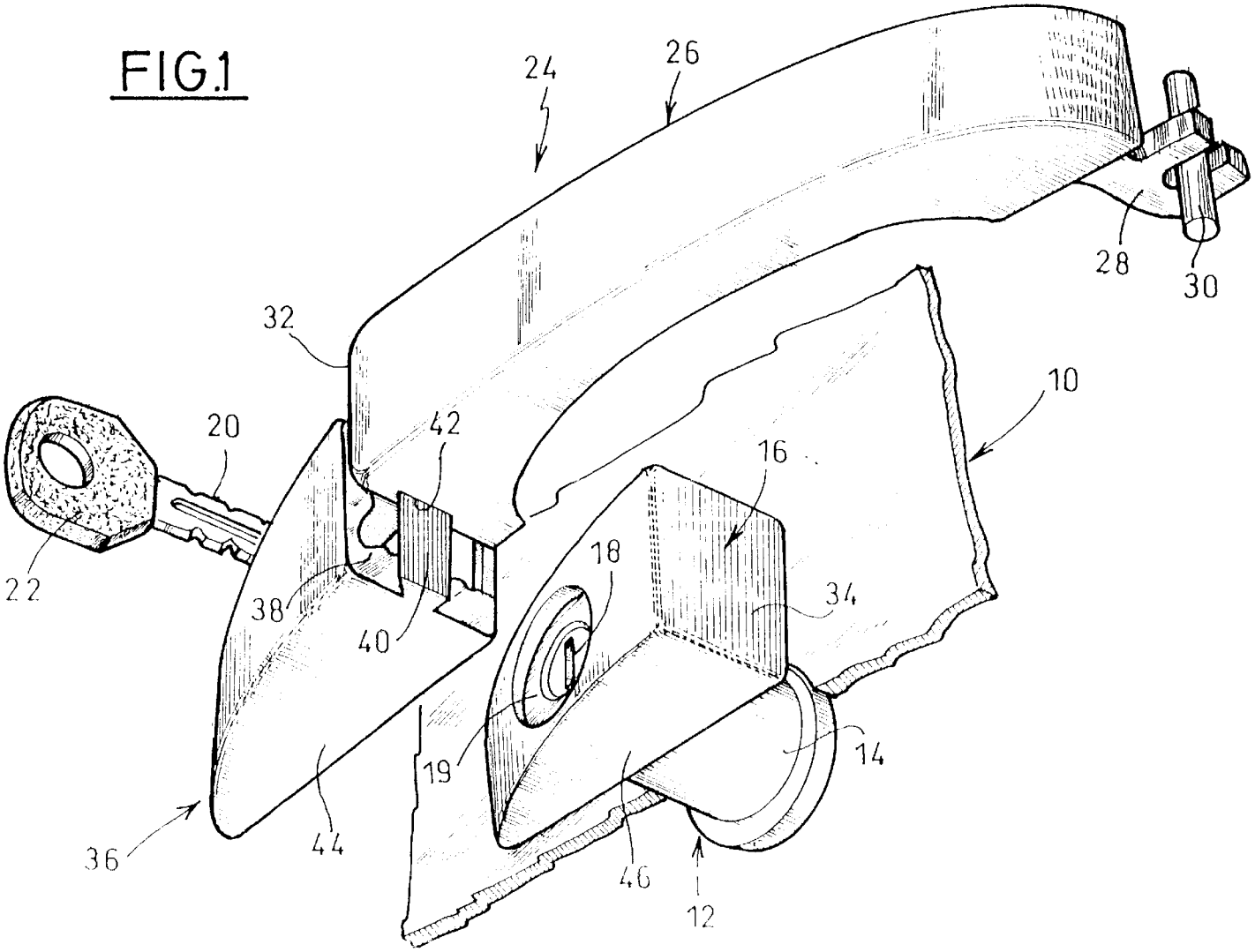
FIG. 1 is an exploded perspective diagrammatic view illustrating the main components of a door handle for an automobile vehicle made according to the provisions of the invention.

The figures show a sheet metal element 10 forming part of a vehicle door, which for example may be part of the external skin of the door.

The sheet metal 10 is fitted with a known type of mechanical cylinder lock 12, of which the cylindrical stator 14 and a block forming an end 16 projecting outside the door can be seen. The general shape of the end 16 is like a parallelepiped, with its external face chamfered and curved, in which fits the cylindrical rotor 19 that comprises a slit 18 into which the shank 20 of a mechanical key 22 can be inserted axially. If the right key for the lock is used, it rotates the rotor of the lock cylinder 12 to act on the associated lock mechanism, that is not shown on the figures.

The door is equipped with a lock maneuvering handle 24 that acts on the lock mechanism to open the door, if the user is authorized to do so either by means of the mechanical key 22 or by means of an electronic key (not shown) carried by the user.

According to one known general design, the handle 24 is essentially composed of a body 26 forming a gripping lever with a longitudinal orientation in which the first end 28 is hinged on the structure of the door around a hinge pin 30, shown diagrammatically, which in this case is globally parallel to the plane of the sheet metal 10 and is in the vertical direction.

The design of the gripping lever 26 as shown is deliberately simplified, in other words the means used to act on the linkage connecting it to the lock are not shown on the figures.

The gripping lever 26 extends longitudinally along a direction globally perpendicular to hinge pin 30, and it is shaped such that the user can easily hold it in his hands to pivot it about hinge pin 30 between its two extreme rest and open positions as illustrated on FIGS. 2 and 3 respectively.

The transverse face at the longitudinal end 32 of the gripping lever 26 opposite its hinged end 28 is a plane facet which, when the gripping lever 26 is in its rest position, extends facing and parallel to the adjacent side face 34 of the end 16 of the lock cylinder 12 so as to form a generally continuous assembly with a slight longitudinal clearance between surfaces 32 and 34.

According to the provisions of the invention, the gripping lever 26 is provided with a protective cap 36 and/or trim covering the lock cylinder 12 that protects and completely conceals the end 16 when the gripping lever 26 is in the rest position.

The cap 36 is a molded hollow part made of a plastic material designed as an envelope surrounding the end 16, the hollow internal profile of the end being the same shape as and complementary to the external profile of the end 16.

The transverse face of the open end 38 of the cap 36 is provided with means for removably attaching it on the gripping lever 26.

These means are preferably composed of a tenon 40 and mortise 42 type assembly, as shown on the figures, in the shape of a dovetail.

The tenon 40 is shown in relief on face 38, while the mortise 42 is hollowed out in the transverse end face 32 of the gripping lever 26.

The orientation of the attachment means 40, 42 is such that it enables assembly and disassembly of the cap 36 with respect to the gripping lever 26 along a sliding direction that is parallel to the hinge pin 30 of the gripping lever 26.

The cap 36 is normally in the raised position on the gripping lever 26 and it thus extends its general shape without any interruption to the continuity.

As can be seen in FIG. 2, when the gripping lever 26 is in the rest position, with its cap 36 mounted on the lever, the cap 36 completely surrounds the end 16 of lock cylinder 12 that is thus fully protected and concealed, the handle 24 providing a particularly aesthetic continuous appearance from the outside.

In the rest position of the gripping lever 26, which is its almost permanent position, the cap 36 cannot be removed and it cannot accidentally escape under the effect of road vibrations, since its parallel and opposite side faces 44 are facing the corresponding side faces 46 of the end 16, which prevents the cap 36 from sliding.

If the user wants to access the slit 18 in the mechanical lock 12 to insert his key 22, he must pivot the gripping lever 26 to its open position illustrated in FIG. 3 in which it can partially or totally pull the cap 36 clear vertically, for example until it is in the position illustrated in FIG. 1 in which the lock cylinder is accessible.

The design according to the invention has another advantage in that it makes it possible to standardize the gripping lever 26, regardless of whether or not the vehicle is equipped with electronic identification means.

The small clearance between the parallel faces 32 of the gripping lever 26 and 34 of the end 16 has deliberately being exaggerated on FIG. 2 to facilitate understanding of the diagram, but is actually small so that the gripping lever 26 and the end 16 can be used without a cap 36.

What is claimed is:

1. A vehicle door handle which comprises an external gripping lever that is designed to be moved by a user from a rest position to an open position, and a lock controlled by the gripping lever, the lock having a lock cylinder which includes a stator, one end of which is accessible from the outside, the lock cylinder having a slit in the accessible end so that a key can be inserted in the lock cylinder through the slit, of the type in which the gripping lever comprises a protective cap covering the lock cylinder that is assembled so that it is free to slide with respect to the gripping lever between a protecting position in which the cap conceals at least the slit in the lock cylinder when the gripping lever is in its rest position, and a displaced position enabling access to the slit for the insertion of a key, wherein the cap is installed free to slide with respect to the body of the gripping lever in a direction parallel to the hinge pin about which the gripping lever rotates with respect to the door wherein the cap can only be moved with respect to the body of the gripping lever when the gripping lever is in the open position.

2. A handle according to claim 1, wherein the cap surrounds the exposed end of the lock cylinder the internal profile of the cap being approximately complementary to the external profile of the end that it surrounds when the gripping lever is in the rest position.

3. A vehicle door handle comprising:

a gripping lever having a hinged end and a free end, the free end having a planar end surface, wherein the gripping lever can rotate in a plane of rotation about the hinged end between a rest position and an open position; and a cap member slidably attached to the planar end surface of the gripping lever, wherein the cap member is slidably moveable perpendicularly to the plane of rotation between a protecting position and a displaced position when the gripping lever is in the open position, and wherein the cap member is held in the protecting position when the gripping lever is in the rest position.

4. A handle according to claim 3, wherein the cap member and the gripping lever are slidably coupled via a mortise and tenon.

5. A handle according to claim 3, wherein the cap member is a molded part made of a plastic material.

6. A vehicle door handle according to claim 3, further comprising:

a lock located adjacent the cap member when the cap member is in the protecting position, the lock adapted to be mounted on a vehicle door, the lock having a lock cylinder and a slit opening in an exposed end of the cylinder, wherein at least the slit opening of the exposed end of the cylinder is covered by the cap member when the gripping handle is in the rest position and the cap member is in the protecting position.

7. A handle according to claim 6, wherein the gripping lever is adapted to be rotatably coupled at its hinged end to a vehicle door via a hinge pin, and wherein the gripping lever is adapted to extend along a direction approximately perpendicular to the hinge pin.

8. A handle according to claim 7, wherein the gripping lever is adapted to be mounted to a vehicle door via a hinge pin that is approximately parallel to the general plane of the door.

9. A handle according to claim 3, wherein the gripping lever is adapted to be mounted to a vehicle door via a hinge pin which is oriented vertically in the vehicle door.

10. A handle according to claim 3, wherein the cap member is adapted to surround the exposed end of a lock cylinder, wherein the internal profile of the cap member is approximately complementary to the external profile of the end that it surrounds when the gripping lever is in the rest position.

* * * * *